US007513264B2

(12) United States Patent
Otterson

(10) Patent No.: US 7,513,264 B2
(45) **Date of Patent: *Apr. 7, 2009**

(54) FLAT SURFACE WASHING APPARATUS

(76) Inventor: Robert C. Otterson, 15594 Westbrook Way, Portland, OR (US) 97229

( * ) Notice: Subject to any disclaimer, the term of this patent is extended or adjusted under 35 U.S.C. 154(b) by 0 days.

This patent is subject to a terminal disclaimer.

(21) Appl. No.: 12/188,310

(22) Filed: Aug. 8, 2008

(65) Prior Publication Data

US 2008/0289661 A1 Nov. 27, 2008

Related U.S. Application Data

(62) Division of application No. 11/983,325, filed on Nov. 8, 2007, now Pat. No. 7,479,192, which is a division of application No. 10/816,664, filed on Apr. 1, 2004, now Pat. No. 7,308,900.

(51) Int. Cl.
*B08B 3/00* (2006.01)
*B08B 3/12* (2006.01)

(52) U.S. Cl. ..... 134/172; 134/173; 134/176; 239/104; 239/172; 239/258; 239/261; 239/589

(58) Field of Classification Search ..... 134/172, 134/173, 176; 239/104, 172, 258, 261, 589
See application file for complete search history.

(56) References Cited

U.S. PATENT DOCUMENTS

| | | | | |
|---|---|---|---|---|
| 3,332,221 | A * | 7/1967 | McCain | 56/295 |
| 4,107,816 | A * | 8/1978 | Matthews | 15/320 |
| 5,029,758 | A * | 7/1991 | Chayer | 239/172 |
| 5,312,044 | A * | 5/1994 | Eaton | 239/225.1 |
| 5,456,412 | A * | 10/1995 | Agee | 239/104 |
| 5,898,970 | A * | 5/1999 | Straiton | 15/321 |
| 6,012,645 | A * | 1/2000 | Poppitz | 239/104 |

* cited by examiner

*Primary Examiner*—Michael Barr
*Assistant Examiner*—Rita R Patel
(74) *Attorney, Agent, or Firm*—Hancock Hughey LLP

(57) ABSTRACT

An engine and high pressure pump are mounted onto a wheeled chassis. High pressure water is distributed to a rotating wand and nozzle assembly on the wheeled chassis so that as the chassis is moved along a linear path, high pressure water is sprayed onto an underlying surface to clean the surface. Optional diffusion plates may be used to prevent high pressure water from being sprayed directly onto the underlying surface in part of the rotational path defined by the wand and nozzle assembly.

20 Claims, 3 Drawing Sheets

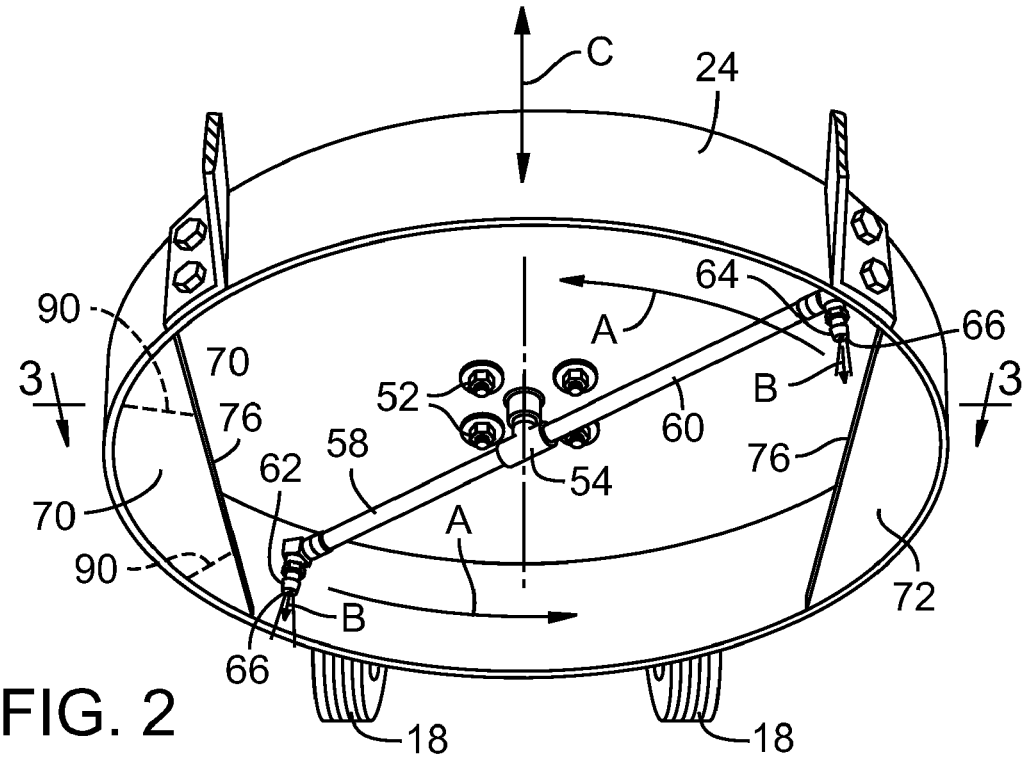
FIG. 2
FIG. 3
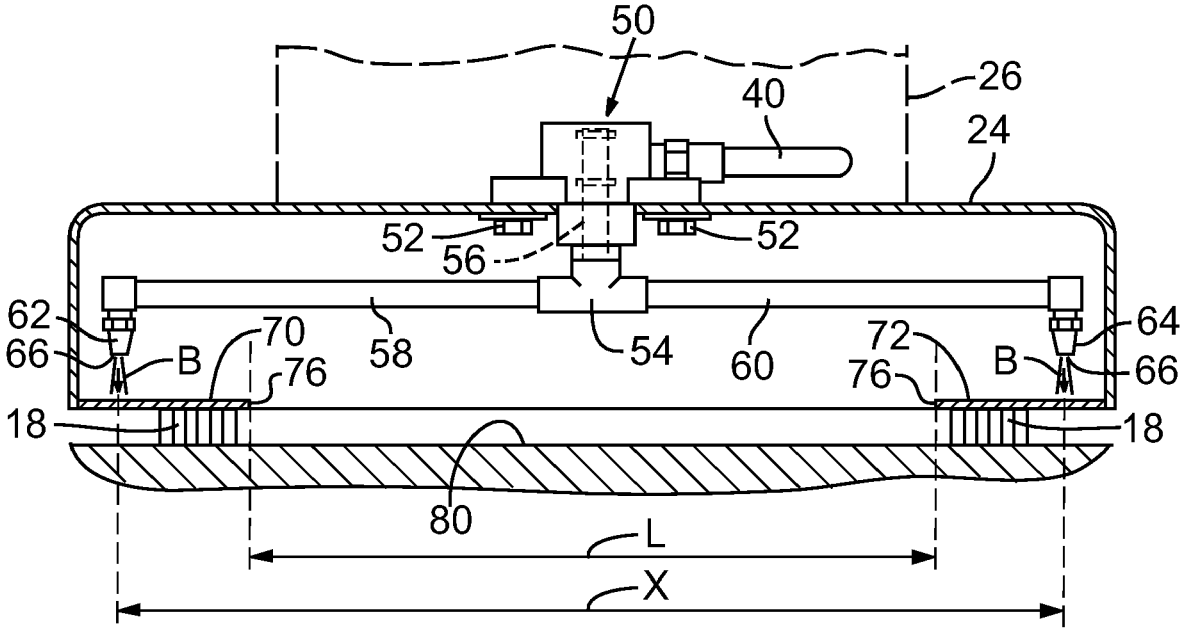

FLAT SURFACE WASHING APPARATUS

RELATED APPLICATIONS

This application is a division of U.S. patent application Ser. No. 11/983,325, filed Nov. 8, 2007, which is a division of U.S. patent application Ser. No. 10/816,664, filed Apr. 1, 2004, now U.S. Pat. No. 7,308,900.

TECHNICAL FIELD

This invention relates generally to high pressure washing systems, and more particularly to a mobile, high pressure washing apparatus for flat surfaces.

BACKGROUND OF THE INVENTION

High pressure washers are useful for cleaning all manner of objects. Although there are many types of high pressure washing systems, a typical system utilizes an engine that powers a high pressure pump. The pump is connected to a water source such as a low pressure hose, and the output of the pump is a high pressure line having a triggered wand. The wand has a nozzle or orifice through which high pressure water is sprayed. Typically, the engine and the high pressure pump are mounted onto a wheeled chassis so that they may be easily moved. Both the low pressure source hose and the high pressure output hose are relatively long so that a relatively large area can be accessed for washing without having to move the engine and pump, which tend to be somewhat cumbersome.

There are high pressure washing systems designed specifically for cleaning flat surfaces. These units use a wheeled stand that houses a rotating wand that is fitted with nozzles. The high pressure water hose from the pump is connected to the handle of the wheeled stand and the unit is moved across the surface that is to be cleaned.

A typical problem encountered with pressure washers is that the water is sprayed at high enough pressure that it can damage the surface that is being washed. These damaging effects can be alleviated to some extent by careful operator use—making sure that the spray stream is kept continually moving to avoid direct high pressure spray for a prolonged period on one spot. Another solution is to use a pressure control valve on the high pressure side of the system to regulate the spray pressure and to thus avoid damage to the surface being cleaned. Neither system is infallible, however, as anyone who has used a pressure washer recognizes. As just one example of the damage that pressure washing can cause, wood may easily be stripped from decking if the pressure washer is improperly used.

The problems caused by pressure washers are particularly acute where the surface that is being washed is relatively easily damaged. For example, flat surfaces that are painted or coated, such as tennis courts, may easily be damaged by improper use of a pressure washer. When the washing is accomplished by using a pressure washer fitted by a wand, not only is there a real possibility of damage, but functional washing of the entire surface is spotty since it is difficult to apply even coverage when using a hand wand.

There is a need therefore for improved high pressure washing systems, and particularly systems designed for washing flat surfaces.

SUMMARY

An engine and high pressure pump are mounted onto a wheeled chassis. High pressure water is distributed to a rotating wand and nozzle assembly on the wheeled chassis so that as the chassis is moved along a linear path, high pressure water is sprayed onto an underlying surface to clean the surface.

BRIEF DESCRIPTION OF THE DRAWINGS

FIG. 2 is a perspective view of the underside of the washing deck of the flat surface washer illustrated in FIG. 1.

FIG. 3 is a partial cross sectional view of the washing deck of the flat surface washer according to the present invention, taken along the line 3-3 of FIG. 2.

DETAILED DESCRIPTION OF ILLUSTRATED EMBODIMENTS

Figures 1, 6:
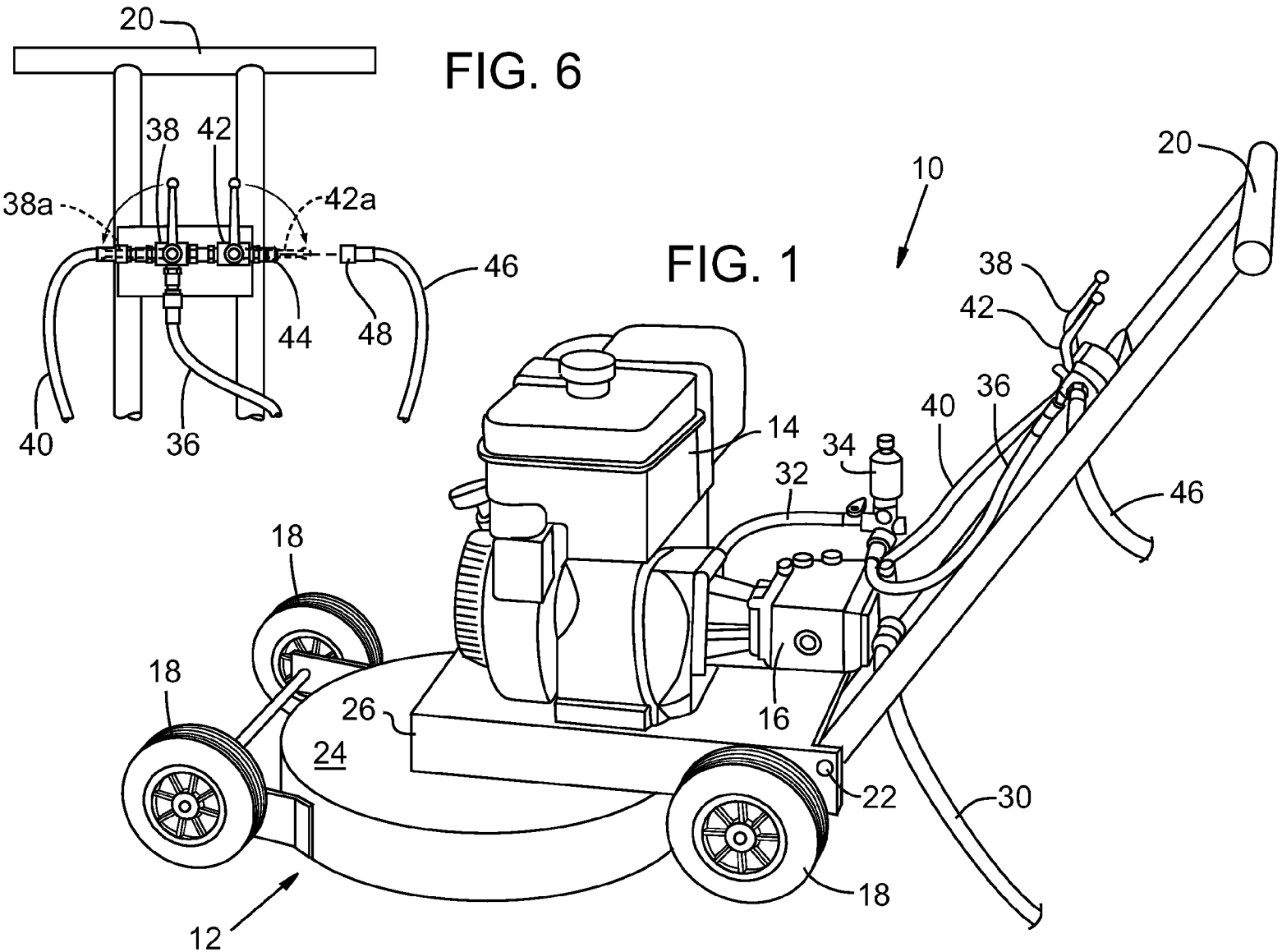
FIG. 1 is a perspective view of a flat surface washer according to the present invention.
FIG. 6 is a frontal view of the handle of the flat surface washer according to the present invention illustrating the control valves.

With reference to FIG. 1, a flat surface washing apparatus 10 is shown as including a chassis 12 on which are mounted an engine 14 and a high pressure pump 16. Chassis 12 includes four wheels 18 (three of which are shown in FIG. 1) and a handle 20 that is preferably pivotally mounted at pivot 22 so that the apparatus 10 may easily be moved. Chassis 12 further comprises a deck 24 that as detailed below houses rotary high pressure spray wands, and a riser housing 26 that encloses various fittings. Engine 14 is mounted on riser housing 26. The engine may be of any type and size appropriate to the system in question. One preferred engine, and the type illustrated in the figures is a gas-powered engine having sufficient power output to operate the high pressure pump 16. Those having ordinary skill in the art will recognize that there are innumerable engines that suffice in a system such as that described herein. The invention described herein is not limited to any particular engine or pump system, although a typical engine has a horsepower rating from about 7 to 15 horsepower.

High pressure pump 16 is similarly of a type and capacity appropriate to the apparatus 10 in question. As with engine 14, numerous kinds of high pressure pumps are commercially available for use with the present invention.

Low pressure water is supplied to apparatus 10 through a low pressure drag line 30 that is connected to a water supply such as a standard hose bib. The engine 14 and high pressure pump 16 operate in a conventional manner. Thus, stated briefly, engine 14 powers pump 16 to pressurize water flowing through the pump. Higher pressure water is output from pump 16 through a high pressure outlet hose 32. A pressure regulating valve 34 is plumbed inline in high pressure outlet hose 32 so that the pressure of output water may be controlled-pressure gauges may optionally be included. The high pressure hose 36 downstream of pressure regulating valve 34 is connected to a high pressure ball valve 38, which preferably is a 3-way valve. With reference to FIG. 6, valve 38 is shown in a first, neutral position in which the valve is open so that water from high pressure hose 36 flows through the valve and is recycled through pump 16 via high pressure hose 40, which is connected to valve 38. When valve 38 is moved to a second position shown in phantom lines in FIG. 6 and labeled with reference number 38*a*, the valve is open and high pressure water flows through the valve into high pressure outlet hose 40 to feed high pressure water to the rotary washing wands housed in deck 24 in the manner described below.

A second high pressure valve 42 is mounted on handle 20 and is connected to valve 38. In FIG. 6, valve 42 is shown with the handle in solid lines in the closed position. When valve 38 is in the neutral position, that is, when the valve is in the position shown with solid lines in FIG. 6, and valve 42 is closed, as noted high pressure water recycles through pump 16. However, when valve 38 is in the neutral position and valve 42 is opened (shown with phantom lines in FIG. 6, reference number 42*a*), the high pressure water is directed to an outlet coupling 44, to which a high pressure hose 46 may be attached. As detailed below, high pressure hose 46 may be fitted to a hand wand for cleaning selected areas.

All hoses described herein may be fitted with quick connect couplings, if desired, so that the hoses may be quickly connected and disconnected. Outlet coupling 44 in FIG. 6 is shown as a quick connect coupling, and hose 46 therefore includes a complimentary quick connect coupling 48.

Turning now to FIGS. 2 and 3, the high pressure rotary wands will be described. High pressure hose 40 is connected to a rotary valve 50 mounted on the upper surface of deck 24, within riser housing 26. Rotary valve 50 is a standard rotary distribution valve having a working capacity consistent with the other components of apparatus 10, including engine 14 and pump 16. A variety of rotary valves are commercially available that are suitable for use with the invention described herein. The rotary valve is attached generally to the center of deck 24, which is circular, in any appropriate manner, such as shown with bolds 52. A T-fitting 54 is fluidly connected to the outlet 56 of rotary valve 50 within deck 24. A pair of wands 58 and 60 is connected to T-fitting 54 and downwardly directed outlet nozzles 62 and 64 are attached to the outer ends of wands 58 and 60, respectively. Each outlet nozzle 62, 64 is fitted with an orifice 66 that directs high pressure water out of the orifice in a specific desired spray pattern. The orifice 66 is threaded onto the nozzle so that the orifice may be quickly changed, for example if a different spray pattern is desired.

While the illustrated embodiment of the invention includes two wands 58 and 60, each having a single nozzle 62, 64, respectively on the ends of the wands, any number of wands may be used, each having a nozzle on the end. Moreover, each wand may include more than one nozzle along the length thereof.

Deck 24 includes two semi circular diffuser plates 70, 72 mounted to opposite sides of the deck such that the diffuser plates are spaced apart from the upper surface of deck 24, and such that the wands 58 and 60 and nozzles 62 and 64 are mounted between the diffuser plates and the upper surface of deck 24. As detailed below, the diffuser plates occlude a portion of the high pressure water that is sprayed from nozzles 62 and 64 as the nozzles rotate. Thus, the wands 58 and 60 are long enough such that the nozzles 62 and 64 extend outwardly beyond the inner edges 76 of the diffuser plates when the wands 58 and 60 are in a portion of their rotational position. The distance between the inner edges 76 of diffuser plates 70 and 72 is shown in FIG. 3 as distance L. The distance X shown in FIG. 3, on the other hand, is the distance that separates nozzles 62 and 64.

The operation of apparatus 10 will now be described. With engine 14 running and a supply of water flowing through low pressure supply hose 30, pressure regulator valve 34 is adjusted so that the pressure of high pressure water output though nozzles 62 and 64 is as desired. Operating pressures may be varied according to the needs of the surface that is being washed. Typically, operating water pressure will be between 1500 and 4000 psi, but the operating pressure may be substantially different from this typical range. With valve 38 in the open position (38*a*) and valve 42 in the off position, high pressure water is fed through rotary valve 50, causing wands 58 and 60 to rotate in the direction shown with arrow A in FIG. 2. Simultaneously, high pressure water is sprayed from nozzles 62, 64, as shown in arrows B in FIGS. 2 and 3. The rotational speed at which wands 58 and 60 rotate varies with the operating pressure of the system. Typical rotational speeds are in the range of 1000 to 3000 rpm, but as with the operational pressures used, the rotational speeds may vary significantly.

With the apparatus operating as noted, the chassis 12 is moved in the direction shown with arrow C in FIG. 2 over a surface to be cleaned.

Figure 4:
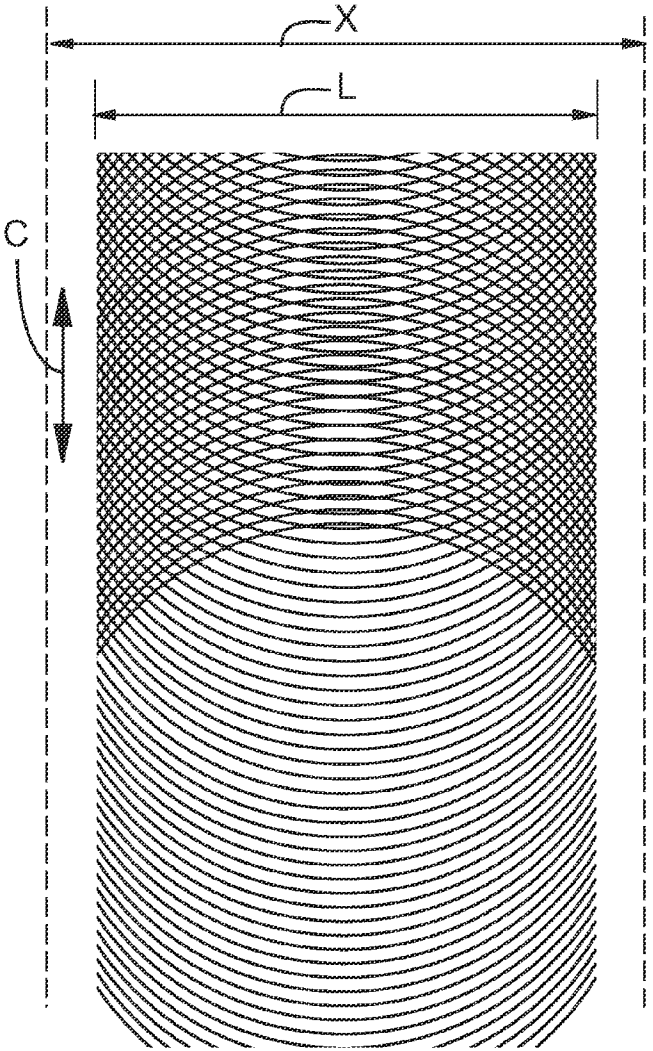
FIG. 4 is a schematic and diagrammatic view of a spray pattern produced by a flat surface washer according to the present invention in which diffuser plates are used.

The spray pattern generated as the chassis 12 is moved in the direction of arrow C will now be explained with reference to FIGS. 4 and 5. Wands 58 and 60 rotate at relatively high rotational speeds as noted above and water sprayed from nozzles 62 and 64 thus is sprayed onto the underlying surface 80 (FIG. 3) in a circular pattern or path when the chassis 12 is stationary. As chassis 12 is moved in the direction of arrow C, the circular pattern generated by water sprayed through nozzles 62 and 64 defines a generally spiraling patter, the width of the spirals of course dictated by factors such as the rotational speed of the wands and the directional speed at which the chassis is moved. As noted earlier and as shown in FIGS. 2 and 3, diffuser plates 70 and 72 occlude water sprayed from nozzles 62 and 64 during a portion of the rotational path that the nozzles follow. Thus, when wands 58 and 60 are roughly transverse to the direction of chassis movement represented by arrow C, water sprayed out of the nozzles is blocked by the diffuser plates 70 and 72 and is thus prevented from being sprayed directly onto surface 80. Stated in another way, when the nozzles 62 and 64 are in that part of their rotational path where the nozzles are above the diffuser plates, water sprayed from the nozzles does not impinge directly on the surface over which the apparatus is being moved. This produces a spray pattern as shown in FIG. 4, in which the lateral sides of the circular spray pattern are truncated. Stated another way, the width of the truncated spray pattern shown in FIG. 4 is limited to the width between the inner edges 76 of the diffuser plates, shown as length L. The length X is shown on FIG. 4 to illustrate that the spray pattern is truncated along the lateral sides as the chassis is moved in the direction of arrow C.

Figure 5:
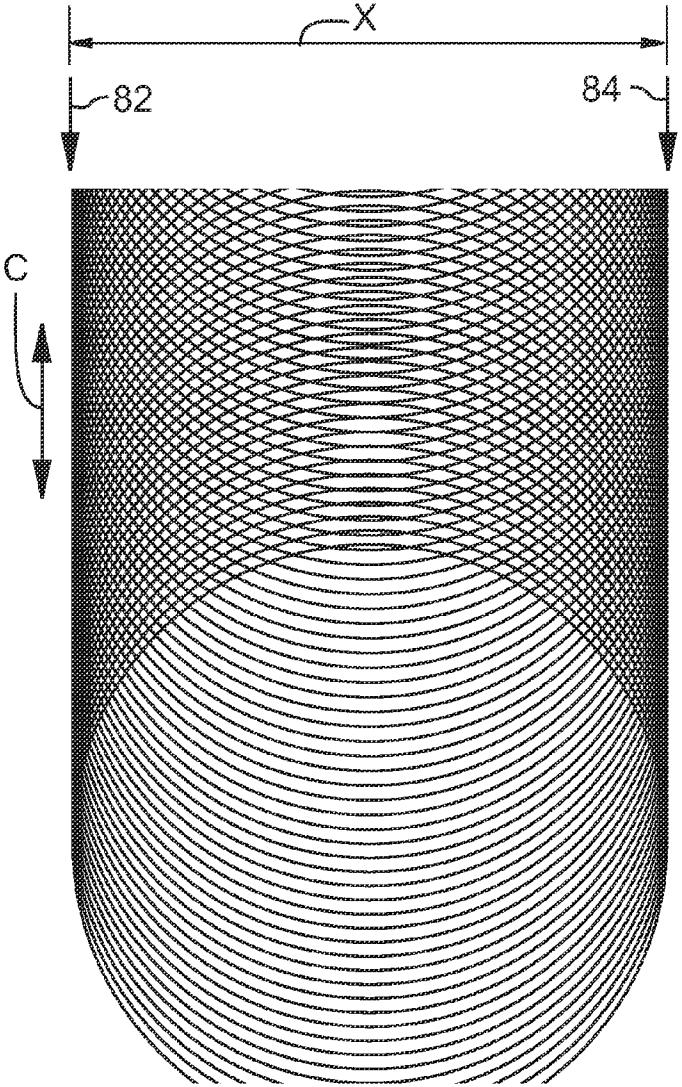
FIG. 5 is a schematic and diagrammatic view of a spray pattern similar to that shown in FIG. 4, except produced with a flat surface washer that does not include diffuser plates.

FIG. 5 illustrates a spray pattern generated when diffuser plates 70 and 72 have been removed. In the absence of the diffuser plates, the spray pattern at the lateral edges 82 and 84 of the rotational pattern is generally a laterally extending line that is parallel to the directional movement of chassis 12 (arrow C). This spray pattern that represents high pressure water sprayed directly onto the surface 80 will exist regardless of the speed at which chassis 12 is moved in the direction or arrow C. Depending upon the spray pattern generated by orifices 66, this spray pattern can result in damage to surface 80. For example, if the surface 80 is coated with paint or a surface coating typical of those applied to tennis courts and the like, the coating may be severely damaged, resulting in visible lines formed in the surface, which results in the need for costly repairs.

It will be appreciated that the shape and width of the diffuser plates 70, 72 may be varied to alter the spray pattern emitted from the nozzles. For example, the width of the diffuser plates 70 and 72 may be increased, which results in a length L that is less than that shown in the figures. The width of the diffuser plates depends to some extent on the spray pattern that is emitted from nozzles 66. Thus, the purpose of the diffuser plates is to prevent damage to the surface that is being cleaned along the lateral edges of the spray pattern as the apparatus 10 is moved over that surface. In most cases, each diffuser plate preferably occludes the spray pattern from hitting the surface 80 through an arc of between about 45° and about 90° for each nozzle as the nozzles rotate. More preferably, each diffuser plate occludes the spray pattern from hitting the surface 80 through an arc of between about 60° and about 75° for each nozzle as the nozzles rotate, although it will be appreciated that the size and shape of the diffuser plates may be varied widely to change this arc. Similarly, the shape of the diffuser plates may be varied. As one example, if the diffuser plate 70 is cut along dashed lines 90 as shown in FIG. 2, leaving out the plate material outwardly of lines 90, the resulting spray pattern will be altered.

The diffuser plates 70 and 72 tend to even the rotational speed of the wands and to eliminate any wobble as the wands rotate. Thus, as the wands rotate into the position where nozzle 62 on wand 58 first passes over the upstream edge of diffuser plate 72, the nozzle 64 on wand 60 is simultaneously passing over the corresponding upstream on diffuser plate 70. Likewise, the two nozzles pass over the downstream edges of the respective diffuser plates simultaneously as the wands rotate. This symmetric movement of the nozzles onto, over and past the diffuser plates as water is sprayed from the nozzles tends to balance the rotation of the wands, reducing or eliminating wobble.

It will be appreciated that while the diffuser plates add significant functional benefits, the plates are optional as the apparatus 10 may be used without them.

It will further be appreciated that apparatus 10 may include inline supplies of detergents and/or solvents that may be metered into the water lines that add to the cleaning ability of the water. Moreover, the supply of water may be heated to enhance cleaning.

Because the engine and pump are mounted on a wheeled chassis, the entire apparatus 10 may be moved over a flat surface to effectively and quickly clean the surface. From on operator's standpoint, it is much easier to drag a low pressure drag line that supplies water to the pump than it is to drag a high pressure line. Furthermore, once a surface area has been cleaned, the control valves 38 and 42 may be switched to direct high pressure water through high pressure hose 46 (which as noted, may have a hand wand attached to the downstream end). This allows the operator to clean by hand isolated spots or areas that require special attention, or to rinse areas that already have been washed.

Having here described illustrated embodiments of the invention, it is anticipated that other modifications may be med thereto within the scope of the invention by those of ordinary skill in the art. It will thus be appreciated and understood that the spirit and scope of the invention is not limited to those embodiments, but extend to the various modifications and equivalents as defined in the appended claims.

The invention claimed is:

1. A method of washing a surface, comprising the steps of:

a) mounting a pair of rotating arms to a wheeled chassis, each of said rotating arms having a nozzle mounted thereon so that the nozzles are in a spaced apart relationship;

b) supplying high pressure fluid to the nozzles;

c) causing the nozzles to rotate so that high pressure fluid sprays from the nozzles in a 360° spray path toward the surface; and d) occluding at least a portion of the 360° spray path so that high pressure fluid is blocked from directly hitting the surface in the blocked portion of the 360° spray path.

2. The method according to claim 1 including the step of moving the wheeled chassis over the surface.

3. The method according to claim 1 including blocking at least a portion of the 360° path at opposed sides of the path.

4. The method according to claim 3 including blocking the path through an arc of at least about 45° on opposite sides of the path.

5. The method according to claim 3 including blocking the path through an arc of between about 60° and 75° on opposite sides of the path.

6. The method according to claim 1 wherein when the wheeled chassis is moved over the surface the high pressure fluid impinges directly onto the surface in a pattern having truncated lateral sides.

7. The method according to claim 1 including the step of mounting diffuser plates on the chassis between the nozzles and the surface so that fluid sprayed from the nozzles impinges directly on the diffuser plates through at least a portion of the 360° spray pattern.

8. The method according to claim 7 including the step of stabilizing the wands while they rotate to prevent the wands from wobbling.

9. The method according to claim 8 wherein the step of stabilizing the wands includes the step of adjusting the size of the diffuser plates and the position of the diffuser plates on the chassis so that each nozzle is either directing water onto a diffuser plate or onto the surface.

10. A method of washing a surface, comprising the steps of:

a) mounting to a wheeled chassis a pair of rotating arms having nozzles mounted in spaced apart positions thereon, said nozzles spaced apart by a distance;

b) mounting to the chassis a pair of diffuser plates, said plates mounted on the chassis such that the diffuser plates are positioned between the nozzles and the surface;

c) pressurizing fluid from a source external to the wheeled chassis and supplying the pressurized fluid to the nozzles;

d) causing the pressurized fluid to spray from the nozzles in a 360° spray path toward the surface; and e) occluding at least a portion of the 360° spray path so that fluid sprayed from the nozzles is blocked from directly hitting the surface when the nozzles pass over the diffuser plates.

11. The method according to claim 10 wherein 360° spray path has a fixed diameter and the distance is equal to the fixed diameter.

12. The method according to claim 10 including blocking at least a portion of the 360° path at opposed sides of the path.

13. The method according to claim 10 including the step of moving the wheeled chassis over the surface so that the 360° spray path defines a continuously spiraling spray path.

14. The method according to claim 10 including mounting an engine and a pump having a low pressure inlet and a high pressure outlet to the chassis.

15. Surface cleaning apparatus, comprising:

a wheeled chassis;

an engine and a high pressure pump, the pump having an inlet configured for attachment to a low pressure fluid source, and a high pressure outlet;

a rotary valve fluidly connected to the high pressure outlet;

at least two nozzles fluidly connected to the rotary valve, each of said nozzles configured for directing fluid toward the surface in a 360° spray path; and means for blocking fluid from each of said nozzles in a portion of the 360° spray path.

16. The apparatus according to claim 15 wherein said means for blocking fluid comprises a pair of diffuser plates mounted to the chassis between said nozzles and said surface.

17. The apparatus according to claim 16 wherein said diffuser plates are mounted on said chassis so that when one nozzle passes over a diffuser plate, the other nozzle also passes over a diffuser plate.

18. The apparatus according to claim 15 wherein each nozzle is mounted to a wand and the wands are configured for rotation, and including wand stabilization means for reducing wobble of the wands as they rotate.

19. The apparatus according to claim 18 wherein the wand stabilization means comprises a pair of diffuser plates mounted to the chassis between said nozzles and said surface.

20. The apparatus according to claim 15 wherein the engine and high pressure pump are mounted to the chassis.

* * * * *